US005580400A

United States Patent [19]

Takahashi

[11] Patent Number: 5,580,400

[45] Date of Patent: Dec. 3, 1996

[54] MAGNETICALLY ANISOTROPIC PERMANENT MAGNET

[75] Inventor: Yasunori Takahashi, Tokyo, Japan

[73] Assignees: Kawasaki Teitoku Co., Ltd.; Komeya Inc.; Sanei Sanei Kasei Co., Ltd., all of Tokyo, Japan

[21] Appl. No.: 435,138

[22] Filed: May 5, 1995

Related U.S. Application Data

[62] Division of Ser. No. 316,354, Sep. 30, 1994, Pat. No. 5,443,617.

[30] Foreign Application Priority Data

Oct. 6, 1993 [JP] Japan ..... 5-272967

[51] Int. Cl.[6] ..... H01F 1/057

[52] U.S. Cl. ..... 148/302; 75/244; 252/62.54

[58] Field of Search ..... 148/302; 75/244; 252/62.54

[56] References Cited

U.S. PATENT DOCUMENTS

| | | | |
|---|---|---|---|
| 4,082,905 | 4/1978 | Stephan et al. | 428/538 |
| 4,323,596 | 4/1982 | Buxbaum et al. | 427/127 |
| 4,367,214 | 1/1983 | Sarnecki et al. | 423/634 |
| 4,400,432 | 8/1983 | Buxbaum et al. | 428/403 |
| 4,663,066 | 5/1987 | Fruchart et al. | 252/62.51 |
| 4,668,283 | 5/1987 | Honda et al. | 148/105 |
| 4,913,890 | 4/1990 | Arndt et al. | 423/633 |
| 5,034,146 | 7/1991 | Ohashi et al. | 252/62.57 |

FOREIGN PATENT DOCUMENTS

| | | | |
|---|---|---|---|
| 61-81606 | 4/1986 | Japan . | |
| 61-81605 | 4/1986 | Japan . | |
| 61-34242 | 8/1986 | Japan . | |
| 63-67705 | 3/1988 | Japan . | |
| 246703 | 2/1990 | Japan | 428/403 |
| 372124 | 11/1991 | Japan . | |

OTHER PUBLICATIONS

Teitaro Hiraga et al., "Ferrite", Maruzen 1988, p. 45 (translation was attached).

*Primary Examiner*—John Sheehan

*Attorney, Agent, or Firm*—Cushman Darby & Cushman IP Group of Pillsbury Madison & Sutro LLP

[57] ABSTRACT

The present invention aims at providing a powdery raw material composition for a permanent magnet superior in the magnetic properties and easy in preparation, a magnetically anisotropic permanent magnet, and a method for producing the magnet by use of the powdery raw material composition. A powdery raw material composition for a permanent magnet according to the present invention is one prepared by subjecting a mixture composed of 13–18 weight % of a neodymium powder, 4–10 weight % of a boron powder and the rest of an acicular iron powder coated with aluminum phosphate to a temperature above 600° C. in an atmosphere initially of a hydrogen-containing reducing gas followed later by an inert gas, and a magnetically anisotropic permanent magnet is prepared by compression molding a mixture obtained from the powdery composition and a binder under heating in the presence of a magnetic field.

5 Claims, 1 Drawing Sheet

MAGNETICALLY ANISOTROPIC PERMANENT MAGNET

This is a division of application Ser. No. 08/316,354, filed Sep. 30, 1994 U.S. Pat. No. 5,443,617.

FIELD OF THE INVENTION

The present invention relates to a powdery raw material composition for a permanent magnet superior in magnetic properties and easy in preparation, a magnetically anisotropic permanent magnet, and a method for producing the permanent magnet by use of the composition.

DESCRIPTION OF THE PRIOR ART

Japanese Patent Publication B-61-34242 discloses a magnetically anisotropic sintered permanent magnet composed of Fe—B—R (R:rare earth element). For the production, an alloy containing the above-mentioned components is cast, the cast alloy is pulverized to an alloy powder, and the alloy powder is molded and sintered. However, the pulverization of cast alloy is a costly step.

SUMMARY OF THE INVENTION

It is an object of the present invention to provide a powdery raw material composition for a Fe—B—R permanent magnet superior in magnetic properties and easy in preparation, a magnetically anisotropic permanent magnet, and a method for producing the permanent magnet by use of the powdery raw material composition.

DETAILED DESCRIPTION OF THE PREFERRED EMBODIMENTS

Figure 1:
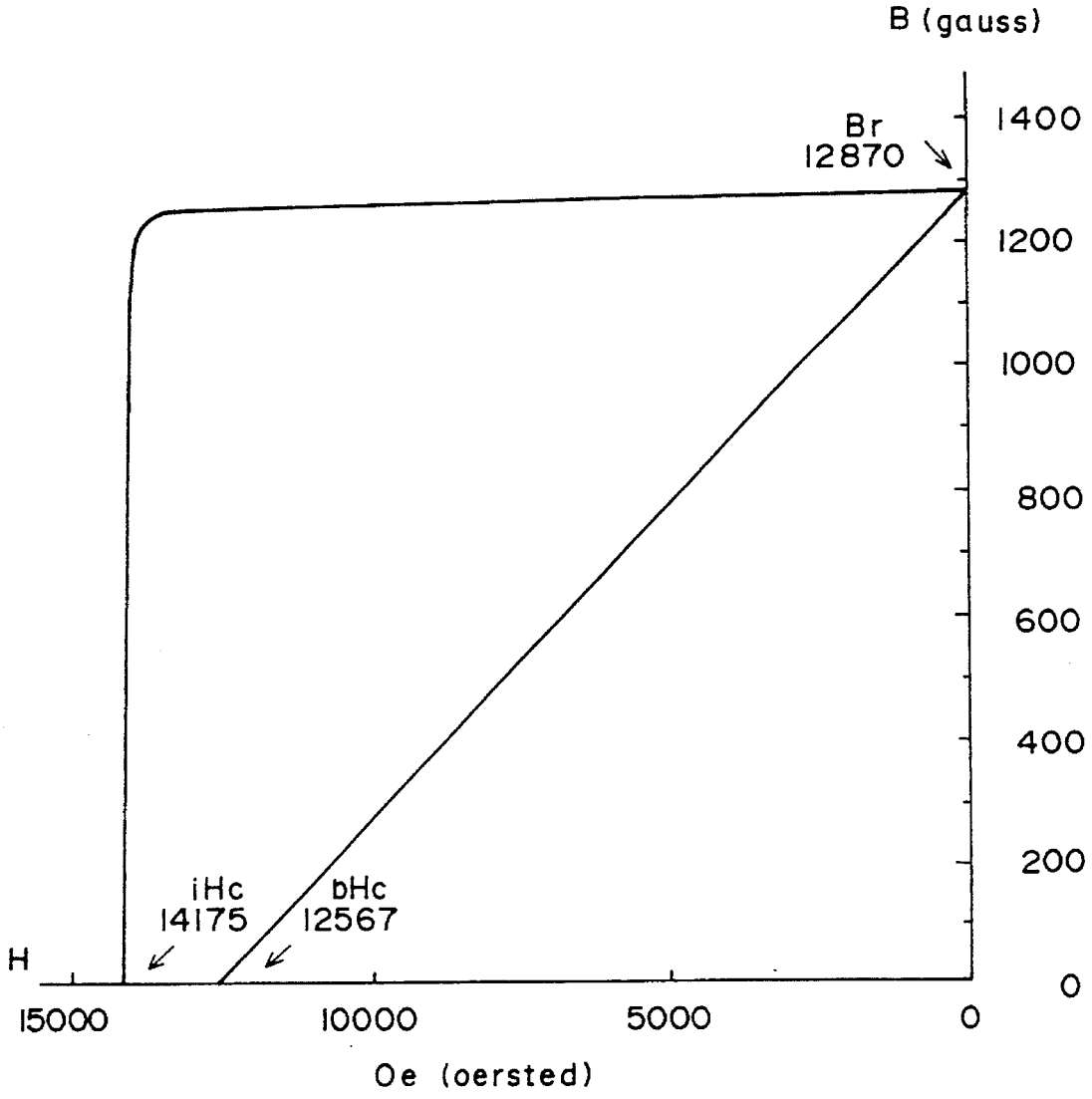
FIG.1 is a graph showing magnetic properties of a permanent magnet according to the invention.

According to the present invention, a powdery raw material composition for a permanent magnet is one prepared by subjecting a mixture composed of 13–18 weight % of a neodymium powder, 4–10 weight % of a boron powder and the rest of an acicular iron powder coated with aluminum phosphate to a temperature above 600° C. in an atmosphere initially of a hydrogen-containing reducing gas followed later by an inert gas, and a magnetically anisotropic permanent magnet is prepared by compression molding a mixture obtained from the powdery composition and a binder under heating in the presence of a magnetic field.

In the present invention, the aluminum phosphate coating on an acicular iron powder not only can prevent oxidation of the iron powder but also enhance magnetic properties of the produced permanent magnet. The ratio of iron powder to aluminum phosphate is preferably from 8:1 to 20:1, and the acicular iron powder coated with aluminum phosphate is prepared by mixing aluminum phosphate with an acicular iron powder immersed in toluene, and then evaporating the toluene. The acicular iron powder coated with aluminum phosphate is also obtainable by reducing under hydrogen atmosphere at 300°–500° C. an acicular goethite (FeOOH) crystal mixed with and covered by aluminum phosphate.

The powdery raw material composition for a permanent magnet is obtained by preparing firstly a powdery mixture composed of 13–18 wt % of a neodymium powder, 4–10 weight % of a boron powder and the rest (83–72 weight %) of an acicular iron powder coated with aluminum phosphate by means of mixing intimately the components in a solvent like toluene for prevention of oxidation, and subjecting the resulted mixture to a heat treatment at a temperature above 600° C. in an atmosphere initially of a hydrogen-containing reducing gas and later of an inert gas. Although exact behavior of the components during the heat treatment is not clear, it is guessed that neodymium and boron are so activated by hydrogen during the heat treatment in a hydrogen-containing reducing gas atmosphere as can disperse into the acicular iron powder coated with aluminum phosphate to form a crystal structure capable of exhibiting later the desired magnetic properties, since no powdery raw material composition for a permanent magnet of desired magnetic properties is obtainable by subjecting the mixture to the heat treatment only in an inert gas atmosphere. The afterward heat treatment in an inert gas atmosphere is for purging hydrogen used to activate neodymium and boron. The hydrogen activating of neodymium and boron begins at around 600° C. and heating at 800°–1000° C. at the maximum is preferred to shorten the processing time.

A magnetically anisotropic permanent magnet is produced by compression molding a mixture of the above-mentioned powdery raw material composition for a permanent magnet mixed with a binder under heating and in the presence of a magnetic field. For the binder are employed polymeric materials like epoxy resins, and more preferably vitrification agents such as MnO, CuO, $Bi_2O_3$, PbO, $Tl_2O_3$, $Sb_2O_3$, $Fe_2O_3$ and combinations thereof.

A powder of molybdenum or niobium may be incorporated together with the binder for the purpose of improving the temperature characteristics of permanent magnet prepared from the powdery raw material composition for a permanent magnet according to the present invention.

The present invention will be illustrated hereunder by reference to an example, however, the invention never be restricted by the following Example.

EXAMPLE 1

Into a rotary kiln was charged acicular FeOOH (goethite; TITAN KOGYO K.K.), and the charge was reduced for 1 hour at 500° C. (raising or lowering rate was 5° C./min) with a gas composed of 10 vol % of hydrogen and 90 vol % of nitrogen flowing at a rate of 10 L(liter)/minute to obtain an acicular iron powder of 0.9 μm length and 0.09 μm width. To 222 g of the acicular iron powder immersed in toluene was added 12 g of aluminum phosphate, mixed well the content, evaporated the toluene, and obtained 234 g of an acicular iron powder coated with aluminum phosphate. The aluminum phosphate coating prevented the iron powder from oxidation. To the aluminum phosphate coated iron powder were added 45 g of a neodymium powder and 21 g of a boron powder, and they were mixed in toluene. A raw material powder was obtained by evaporation of the toluene. The powder was processed in a rotary kiln by heating to 880° C. at a 5° C./minute raising rate in an atmosphere of a reducing gas composed of 10 vol % of hydrogen and 90 vol % of nitrogen, maintaining at the temperature for 1 hour, maintaining at the temperature for further 1 hour in nitrogen atmosphere, and cooling at a 5° C./minute lowering rate. Thus, a powdery raw material composition for a magnet was obtained.

To 100 g of the powdery composition was added 4 g of vitrification agent (GA-8/500; NIPPON DENKIGARASU K.K.) and mixed. The mixture was molded and subjected to a magnetic field of 15 KOe, a pressure of 30 t/cm$^2$, heating up to 500° C. with 5° C./minute raising rate and maintaining for 2 hours at the temperature to obtain a bond magnet. The magnet had magnetic properties shown below and in FIG.1:

Br: 12870 Gs bHc: 12567 Oe iHc: 14175 Oe $BH_{max}$: 40.4 MGOe

Hc/iHc: 98.4 Perc

Hc: 13951 Oe $4 \times I_m$: 12873 Gs

I claim:

1. A magnetically anisotropic permanent magnet, wherein said magnet has been produced by compression molding a mixture comprising a powdery composition and a binder under heating in the presence of a magnetic field, in which the powdery composition was prepared by subjecting a mixture composed of 13–18 weight % of a neodymium powder, 4–10 weight % of a baron powder and the rest of an acicular iron powder coated with aluminum phosphate to a temperature above 600 ° C. in an atmosphere initially of a hydrogen-containing reducing gas followed by subjecting the powdery composition to a temperature above 600° C. in an inert gas.

2. A magnetically anisotropic permanent magnet according to claim 1, wherein the weight ratio between the acicular iron powder and aluminum phosphate is 8:1–20:1.

3. A magnetically anisotropic permanent magnet according to claim 1 wherein the binder is selected from the group consisting of epoxy resins, polyamide resins, MnO, CuO, $Bi_2O_3$, PbO, $Tl_2O_3$, $Sb_2O_3$, and $Fe_2O_3$.

4. The magnet according to claim 3, wherein the binder comprises and epoxy resin.

5. The magnet according to claim 4, wherein the vitrification agent is selected from the group consisting of MnO, CuO, $Bi_2O_3$, PbO, $Tl_2O_3$, $Sb_2O_3$, $Fe_2O_3$, and mixtures thereof.

* * * * *